United States Patent [19]

Mezger

[11] Patent Number: 4,530,315

[45] Date of Patent: Jul. 23, 1985

[54] CYLINDER BLOCK

[75] Inventor: Hans Mezger, Freiberg, Fed. Rep. of Germany

[73] Assignee: Harley-Davidson Motor Co., Inc., Milwaukee, Wis.

[21] Appl. No.: 630,704

[22] Filed: Jul. 13, 1984

[30] Foreign Application Priority Data

Jul. 21, 1983 [DE] Fed. Rep. of Germany ..... 3326317

[51] Int. Cl.[3] ..... F01P 3/02

[52] U.S. Cl. ..... 123/41.74; 123/41.79

[58] Field of Search ..... 123/41.72, 41.74, 41.79, 123/41.83, 41.02

[56] References Cited

U.S. PATENT DOCUMENTS 2,654,355 10/1953 Scheiterlein ..... 123/41.74
4,082,068 4/1978 Hale ..... 123/41.02

FOREIGN PATENT DOCUMENTS 648930 7/1937 Fed. Rep. of Germany .
J 8282 1/1956 Fed. Rep. of Germany .
2015546 11/1970 Fed. Rep. of Germany ... 123/41.74
2553291 4/1979 Fed. Rep. of Germany .
58-51244 3/1983 Japan ..... 123/41.72

OTHER PUBLICATIONS

"M.G.O. Quick-Running Engines", Diesel Railway Traction, Apr., 1961, pp. 135–137.

*Primary Examiner*—William A. Cuchlinski, Jr.

[57] ABSTRACT

A one-piece cylinder block for a water-cooled internal combustion engine with two rows of cylinders in a V-arrangement has a longitudinal duct for supplying cooling water. The block is preferably made by a die-casting process. The longitudinal duct is connected to the coolant spaces of the cylinders which are located between a cylinder sleeve and an outer jacket surrounding the latter. The longitudinal duct is disposed between the rows of cylinders in the cylinder block and at least one opening is provided in the region of the coolant spaces for each cylinder. These openings are cast in the casing walls of the cylinder block. Since they are disposed directly adjacent the longitudinal duct, they extend essentially radially to the cylinders.

3 Claims, 5 Drawing Figures

CYLINDER BLOCK

BACKGROUND OF THE INVENTION

1. Field of the Invention

The present invention relates generally to the art of cylinder blocks for internal combustion engines, and more particularly, to the cooling of such engines.

2. Description of the Prior Art

In a known cylinder head (German patent specification No. 29 04 167), produced by the diecasting process, the cooling water ducts are formed by integrally cast pipes. The pipes are connected to one another and extend transversely over the entire cylinder block towards the cooling spaces. The pipes typically have a relatively great length. In the regions in which they are in contact with the cooling spaces in the cylinder block, passage openings are provided.

Such a construction of the cooling water ducts is advantageous because the ducts have a defined cross-section. However, such an arrangement of pipes in a cylinder block is very hard to produce in a diecasting process. Moreover, the coolant is supplied to the cooling spaces of the cylinders transversely over the cylinder block. Because of the flow path, the flowing cooling medium may already be heated before it reaches the space adjacent the cylinders.

In other known constructions, in which integrally cast pipes are not used in the cylinder block or head, ducts with outer apertures result from the casting technique. These must be closed by means of additional stoppers, covers or the like.

OBJECTS AND SUMMARY OF THE INVENTION

It is a primary object of the present invention to provide a cylinder block water cooling system which provides selective cooling of the regions of the cylinders which are subjected to high heat stress.

Another object of the present invention is to provide an arrangement of cooling water ducts in a cylinder head or block which can be easily produced using permanent cores in a high pressure casting process.

A further object of the present invention is to provide a cylinder block which requires no substantial finishing after production in a casting process.

How these and further objects of the invention are accomplished will be described in the following specification, taken in conjunction with the drawings. Generally, however, they are accomplished by a cylinder block design which has defined cross-section cooling water ducts and no pipes. Openings to the coolant spaces of the cylinders are provided to a longitudinal duct, the openings being produced during the casting process. This is accomplished by shaping the casing wall adjacent the longitudinal duct so that a shaped portion thereof projects into the longitudinal duct and causes a penetration in this region during casting. The longitudinal duct is arranged between the rows of cylinders to shorten the path to the coolant spaces, resulting in water of equal quantity and temperature being provided to each cylinder. As a result of the efficient cooling of the cylinders, engine efficiency is increased, emission problems are reduced and fuel consumption is decreased.

The longitudinal duct has a single outer aperture which is connected to the cooling water pump, which in turn is connected to the water reservoir by a supply line. This duct connection of the pump to the aperture further insures that the cooling fluid is supplied directly to the longitudinal duct and into the coolant spaces. By using this type of construction, closures such as covers, stoppers or the like, as used in the prior art, are not required. Re-usable cores may be employed in the diecasting process and finishing work is not necessary. The ducts and openings are precisely produced. The openings are produced by means of the adjoining cores in the opening region. In the preferred embodiment the longitudinal duct is trapezoidal in cross-section, with its lateral walls extending parallel to the cylinders. Also the casing wall includes a U-shaped duct in the region of the openings so as to provide an approximately rectangular opening to maximize flow for the cooling medium.

DESCRIPTION OF THE PREFERRED EMBODIMENT

Figure 1:
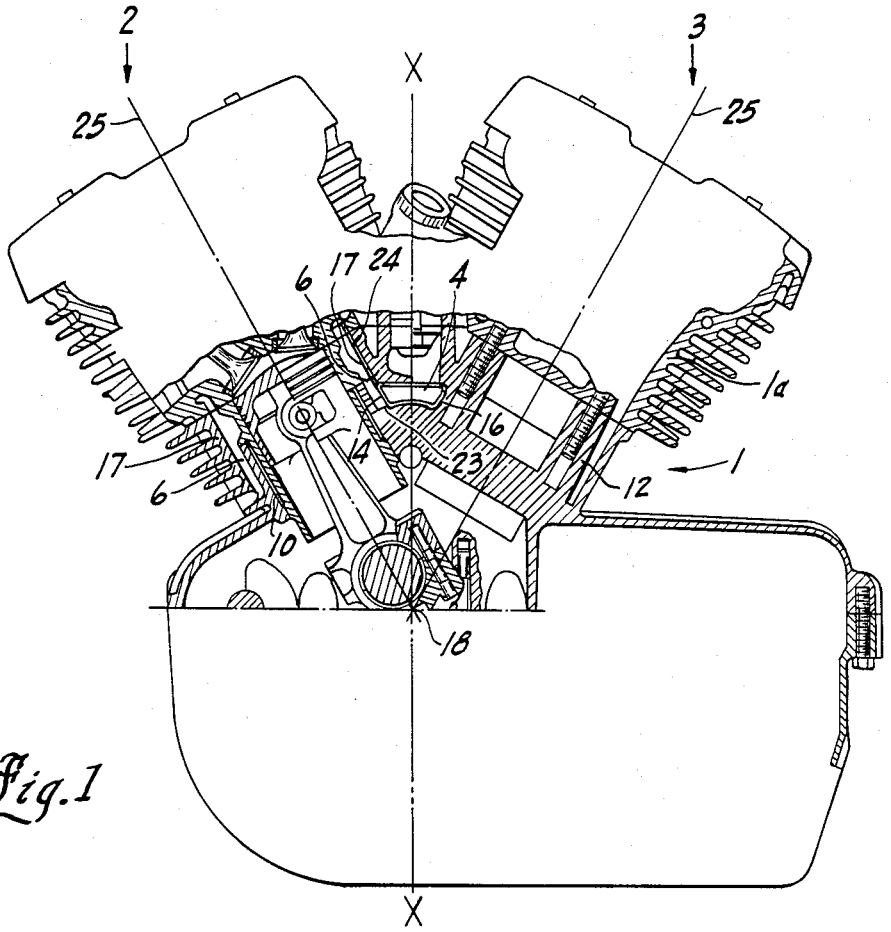
FIG. 1 is a cross-section through an internal combustion engine showing a longitudinal duct and a plurality of coolant spaces.
Figure 2:
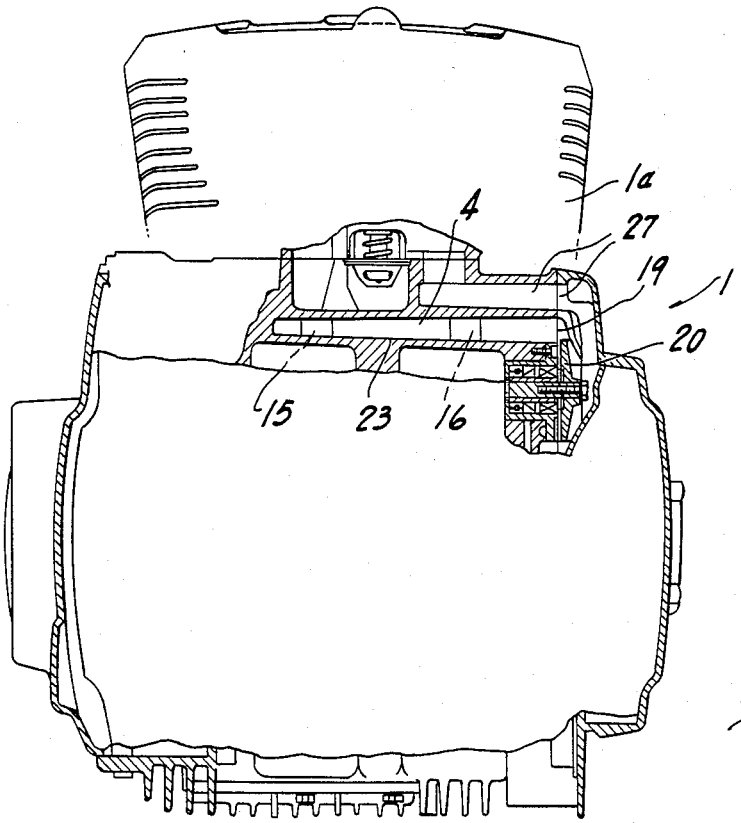
FIG. 2 is a longitudinal section through the internal combustion engine shown in FIG. 1.

A one-part cylinder block 1 for a water-cooled internal combustion engine has two rows of cylinders 2 and 3 which are disposed in a V-shape. Between these two rows of cylinders 2 and 3, there is provided a longitudinal duct 4 which has openings 13, 14, 15, 16 to the individual coolant space 5, 6, 7 and 8 of the individual cylinders 9, 10, 11 and 12. The coolant spaces 5–8 extend in an annular manner around the cylinders 9 to 12 and are defined outwardly by a wall 17 of the casing wall of the cylinder block 1.

The longitudinal duct 4 is preferably disposed in a vertical longitudinal center plane (X—X) extending through the crankshaft axis 18. It extends in the longitudinal direction approximately as far as the two rear cylinders 9 and 11 and is closed at this point. At the end of duct 4 opposite this closure, an outer aperture 19 is provided which is connected to a cooling water pump 20. Pump 20 is connected to a cooling water inlet 21.

The longitudial duct 4 is preferably trapezoidal in cross-section with the longer side of the trapezium being directed towards the cylinder head 1*a*. Openings 13 to 16 are provided in its lateral walls 21 and 22 at a distance behind one another corresponding to the spacing between the cylinders. The openings extend directly from the longitudinal duct 4 in a transverse manner and open into the corresponding coolant spaces 5, 6, 7 and 8, to provide a short path during which the coolant is exposed to heat.

Figure 4:
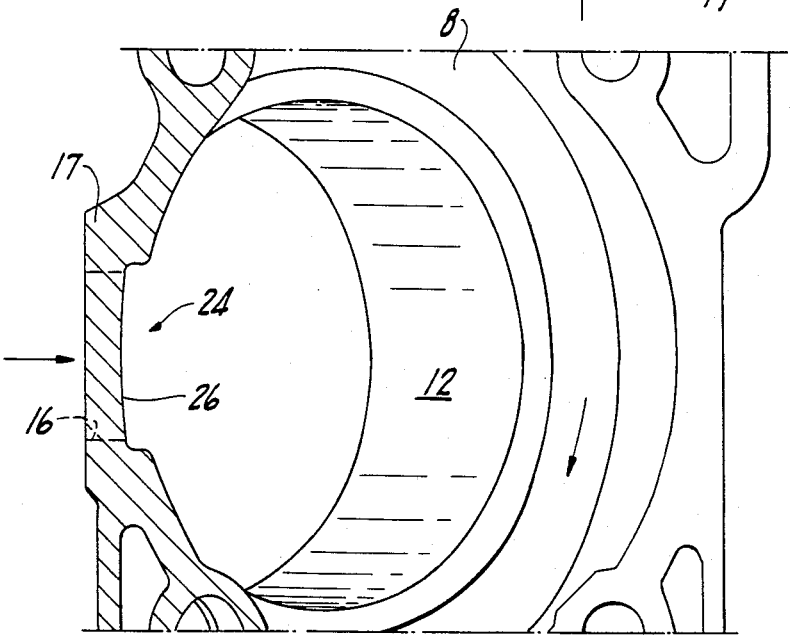
FIG. 4 is a horizontal section through a U-shaped duct in an inner casing wall of the coolant space of the internal combustion engine.
Figure 5:
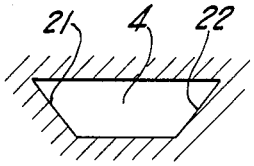
FIG. 5 is an enlarged diagrammatic representation of the trapezoidal longitudinal duct shown in the previous FIGURES.

Each coolant space 5 to 8 is provided in the vicinity of its respective openings 13 to 16 with a duct 24 having a U-shaped cross-section. Duct 24 extends in an upward direction (FIG. 4). The inner face 26 of duct 24 extends parallel to the cylinder axis 25 and to the lateral wall face 21 or 22 of the longitudinal duct 4. This duct 24 is shaped and positioned with respect to the longitudinal duct such that during casting, the openings 13 to 16 are produced by the cores in their overlap region. These openings are approximately rectangular and have an opening face inclined towards the course of the inner face 26. The openings 13 to 16 are located in such a way, with respect to the coolant spaces 5 to 8, that they open at the base 23. Thus the lower, shorter face of the trapezoidal longitudinal duct 4 extends approximately in one plane with the face of the base 23 of the U-shaped duct 24.

Because of the arrangement of the longitudinal duct 4, extending in a horizontal plane, and of the coolant spaces 5 to 8, and because the U-shaped ducts extend in a plane inclined to the vertical, simple production is possible. The cores may be readily removed from the ducts because they are unobstructed.

Figure 3:
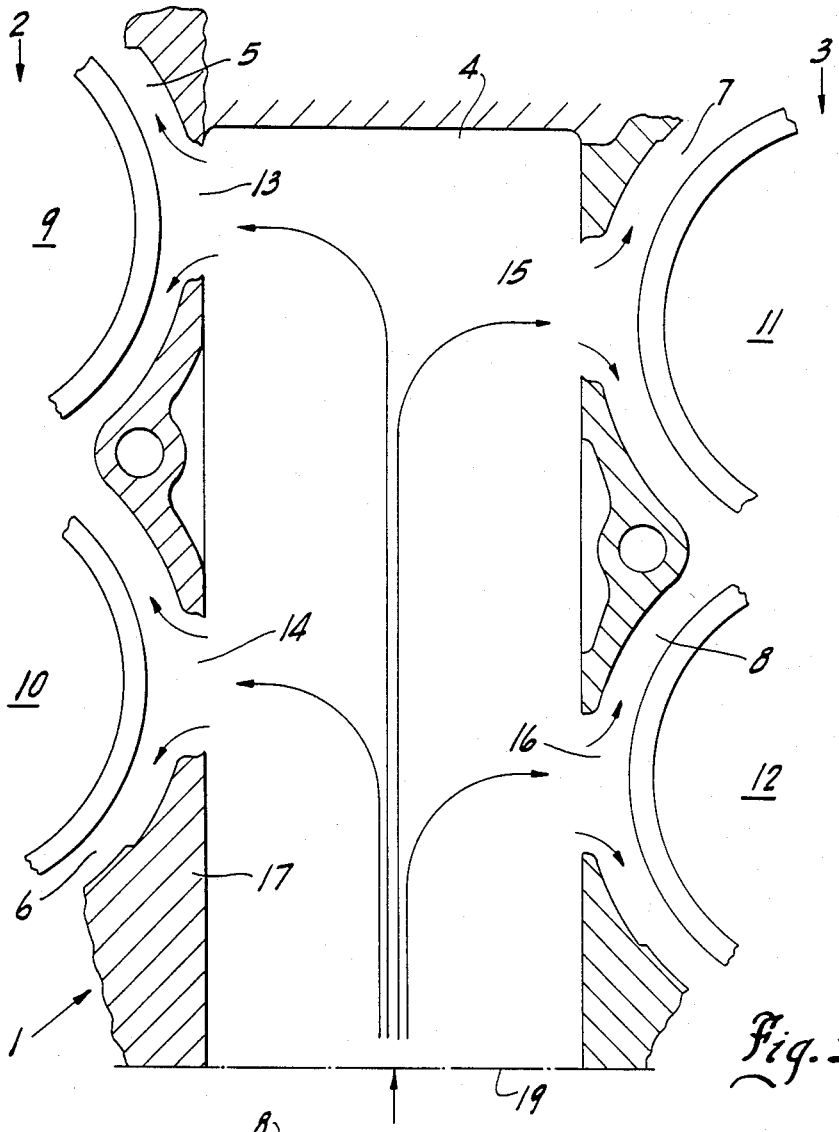
FIG. 3 is a diagrammatic horizontal section of the longitudinal duct of the cylinder block shown in FIG. 1, showing the openings into the coolant spaces of the cylinders.

The cooling medium is fed from the radiator (not shown) by way of the line 27 of the cooling water pump 20 and is then conveyed into the longitudinal duct 4. From the duct, it is fed through the openings 13, 14, 15 and 16 directly to the respective coolant spaces 5, 6, 7 and 8 without being diverted. After flowing around the cylinders, the cooling medium is returned. The arrows shown in FIG. 3 indicate essentially the flow path.

I claim:

1. A one-piece die cast cylinder block for a water-cooled internal combustion engine having a crankshaft and which includes two rows of cylinders in a V arrangement, said block including a longitudinal duct for supplying the cooling water for said engine, said duct being connected to the coolant spaces of the cylinders which are located between a cylinder sleeve and an outer jacket part surrounding said sleeve, said longitudinal duct being disposed between the rows of cylinders of the cylinder block in the region of the coolant spaces for each cylinder, openings cast in a casing wall of said cylinder block, said openings being disposed directly adjacent the longitudinal duct and extending essentially radially to the cylinder, said longitudinal duct being disposed in a vertical longitudinal center plane of said cylinder block, said plane extending through the crankshaft axis of said engine, said longitudinal duct being trapezoidal in cross-section, the longer side of the trapezium being directed upwardly and the lateral faces of said trapezium of said duct extending approximately parallel to the axis of a corresponding cylinder, said longitudinal duct extending approximately as far as the rear cylinders of said engine of each row and wherein a cooling water pump is connected to the outer aperture of said duct.

2. A one-piece die cast cylinder block for a water-cooled internal combustion engine having a crankshaft and which includes two rows of cylinders in a V arrangement, said block including a longitudinal duct for supplying the cooling water for said engine, said duct being connected to the coolant spaces of the cylinders which are located between a cylinder sleeve and an outer jacket part surrounding said sleeve, said longitudinal duct being disposed between the rows of cylinders of the cylinder block in the region of the coolant spaces for each cylinder, openings cast in a casing wall of said cylinder block, said openings being disposed directly adjacent the longitudinal duct and extending essentially radially to the cylinder, said coolant space of each cylinder being annular in shape and extending as far as a transverse center plane of the cylinder, in which plane said openings of said longitudinal duct open into the respective coolant spaces, said openings being rectangular in the area where they are coupled to the coolant spaces, a casing wall enclosing the cylinders in a circular manner and in each case including a second duct with a U-shaped cross-section which opens into said openings and which extends in an upward direction parallel to the axis of the cylinder and which is open towards said coolant spaces.

3. The invention set forth in claim 2 wherein the inner faces of said openings extend in the base of said second duct in one plane with the inner lateral face of said longitudinal duct, in such a way that in the overlap region of the longitudinal duct, the second duct openings are formed.

* * * * *